United States Patent [19]

Jud

[11] Patent Number: 4,826,011

[45] Date of Patent: May 2, 1989

[54] PACK FOR PACKAGING A MATERIAL IN THE FORM OF PIECES

[75] Inventor: Wilfried Jud, Obergrafendorf, Austria

[73] Assignee: Folienwalzwerk Bruder Teich AG, Obergrafendorf, Austria

[21] Appl. No.: 67,789

[22] PCT Filed: Aug. 12, 1987

[86] PCT No.: PCT/AT86/00062

§ 371 Date: Jul. 8, 1987

§ 102(e) Date: Jul. 8, 1987

[87] PCT Pub. No.: WO87/02011

PCT Pub. Date: Apr. 9, 1987

[30] Foreign Application Priority Data

Sep. 27, 1985 [AT] Austria ..... 2817/85

[51] Int. Cl.[4] ..... B65D 73/00

[52] U.S. Cl. ..... 206/484; 383/84; 383/86; 383/88; 383/99

[58] Field of Search ..... 206/484; 385/59, 61, 385/81, 82, 83, 85, 88, 89, 38, 99

[56] References Cited

U.S. PATENT DOCUMENTS 3,570,751 3/1971 Trewella .

FOREIGN PATENT DOCUMENTS 2032994 11/1970 France .
693888 7/1953 United Kingdom .

*Primary Examiner*—Joseph Man-Fu Moy
*Attorney, Agent, or Firm*—Bierman and Muserlian

[57] ABSTRACT

Gas-sealed pack for receiving pieces of a material such as chocolate tablettes. It consists of an envelope (9) of a flat and foldable material, having two edge regions (6, 6') inside which is located a detachable joining strip (7) to provide a sealed closure, preferably by cold sealing. These edge regions are folded back onto the upper surface of the envelope (9). The outside of the edge region (6'), which is applied to the top surface of the envelope (9), is linked at least on part of its surface with the surface of the envelope (9) preferably by means of a hot melting adhesive. The other edge region (6), which is not connected to the upper surface of the envelope (9), does not extend as far as the joining strip (7). A fold (3) is preferably arranged on this edge. The inner surfaces of the envelope are joined by cold sealing. Thus the pack is preferably designed in a tubular shape. To open the pack the edge region (6) is gripped at the fold (3) and pulled away from the edge region (6') while releasing the seal in the region of the joining strip (7).

6 Claims, 3 Drawing Sheets

PACK FOR PACKAGING A MATERIAL IN THE FORM OF PIECES

TECHNICAL DOMAIN

The invention relates to a pack, essentially impermeable to air, for packaging a material in the form of pieces or one that is divisible or divided into pieces, with an envelope formed of a flat, foldable material, having two edge regions of the packaging material joined together by means of a detachable seal at the inside of the packaging material within a sealing region, particularly one in the form of a strip. The packs according to the invention shall preferably, but not exclusively, be executed as tubular bag packs. The two edge regions of the packaging material joined together by such a detachable seal then form the longitudinal sealing seam, called pane, of the tubular bag pack.

STATE OF THE ART

A tubular bag pack of this type, serving particularly for packaging chocolade bars, is known from the German [Unexamined] Patent Application DE-OS 24 58 462. Here, the longitudinal sealing seam is located particularly along a dividing notch of the chocolate bar, namely at the rear side of the envelope that is away from the notch. To open the pack, the chocolate bar is broken off along this dividing notch in such a manner that the longitudinal sealing seam comes to lie along the outer side of the break. The two edge regions of the packaging material that are joined together in the longitudinal sealing seam are stripped apart by the separation of the sealing joint during the progressive breaking of the pack, starting from the inside of the pack, to finally creating an opening in the envelope.

The pack described in the aforementioned application has been used extensively as a chocolate wrapper during the past few years. However, in order to ensure a clean break of the material to be packaged, it is necessary that the longitudinal sealing seam is in practice always situated along a dividing notch or spot. This constitutes a not inconsiderable limitation of the possibilities for arranging the longitudinal sealing seam.

DESCRIPTION OF THE INVENTION

It is the object of the invention to create a pack of the aforementioned type in which the sealing seam, in which the two edge regions of the packaging material are joined together, can be arranged without regard to the position of a dividing notch or spot of the product to be packaged, and that can be opened without breaking off the packaged product, in a simple manner and, if need be, also with one hand.

The underlying problem of the invention is solved by the pack according to the invention, which is characterized by that the edge regions of the packaging material joined together by a seal in a strip-shaped sealing region are folded back onto the outer surface of the envelope, whereby the outside of the edge region adjoining the outer surface of the envelope is joined by bonding to the outer surface of the envelope over at least a part of its surface, and that the strip-shaped sealing region does not extend to the edge of the packaging material, at least at the edge region not bonded to the outer surface of the envelope. Said bonding to the outer surface of the envelope is advantageously carried through by a hotmelt adhesive.

According to an advantageous embodiment of the invention, the pack according to the invention is a tubular bag pack, in which the edge regions of the packaging material joined together by a seal and folded back onto the outer surface of the envelope form the longitudinal sealing seam of the tubular bag, and in which the outer surface of the edge region folded back and adjoining the outer surface of the envelope is joined by bonding to the envelope surface only at or in the region of the cross seal(s) of the tubular bag pack.

According to a further embodiment of the pack according to the invention, the latter is a tubular bag pack with longitudinal and cross sealing seams produced by cold sealing.

In another advantageous embodiment of the pack according to the invention, the latter is characterized by that in the edge region not bonded with the envelope surface, the packaging material forms a fold between the strip-shaped bonding region and the edge of the packaging material, in which fold the insides of the packaging material adjoin each other. The insides of the packaging material are advantageously joined by cold sealing.

BRIEF DESCRIPTION OF THE DRAWINGS RELEVANT TO THE INVENTION IN CONNECTION WITH A WAY TO CARRY THROUGH THE INVENTION

The invention is explained below in detail with the aid of the figures. When a packaging material is shown in these figures in section, it is shown excessively thick to convey better understanding.

Figures 1, 1A:
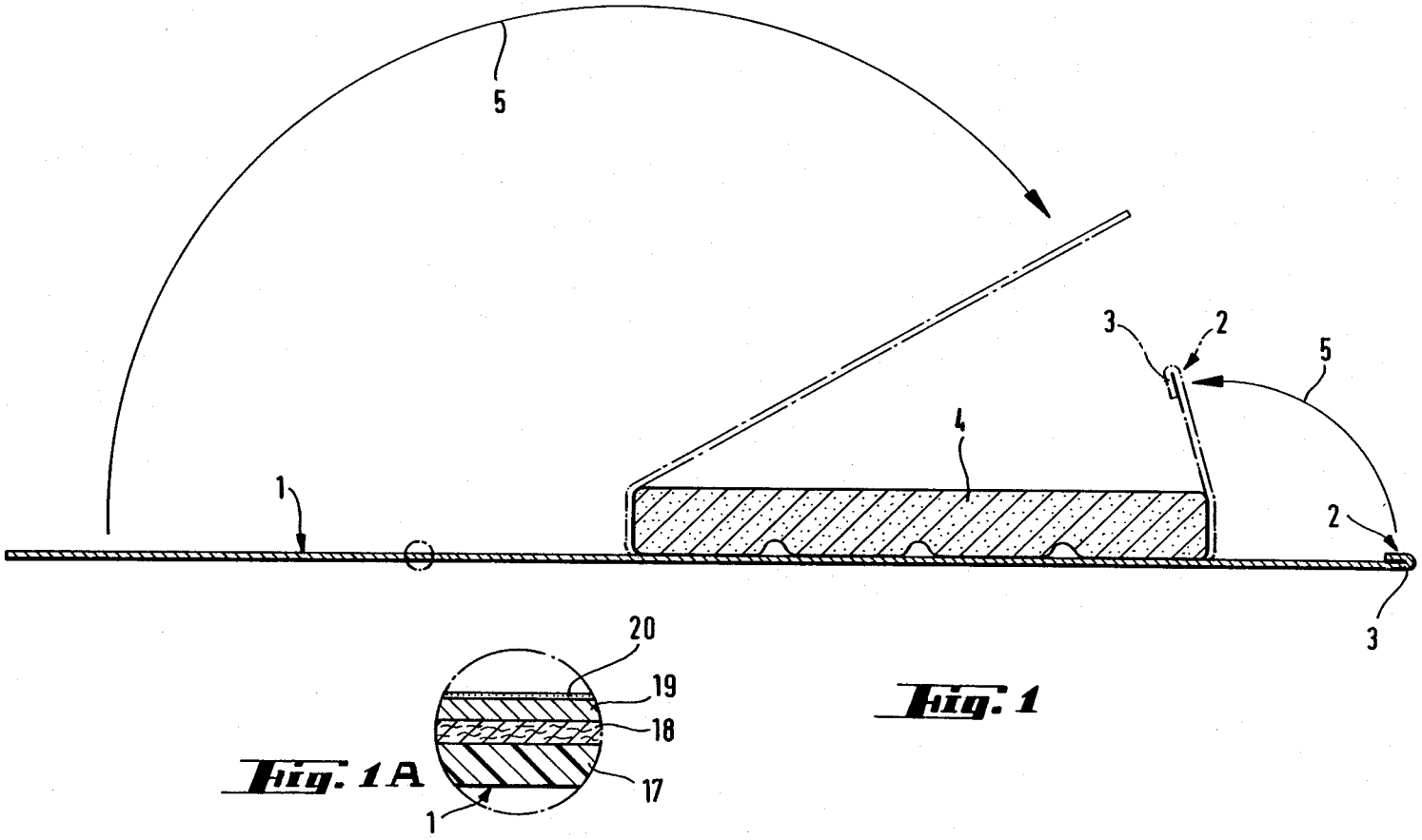
FIG. 1 is a cross-section of a preferred embodiment of a tubular bag pack prior to the formation of the packing material tube.

FIG. 1 illustrates the production of a preferred design of the pack of the invention in the form of a tubular bag pack prior to forming the packaging material tube.

In a packaging machine, on a length of packaging material 1 pulled of a roll, which on one side is provided with a cold sealing coating appropriately arranged in profile, a fold 3 is first formed at an edge 2, whereby the insides of the packaging material adjoining each other in the region of fold 3 are joined by cold sealing. The length of packaging material 1 provided thusly with an edge-fold 3 is moved in its longitudinal direction (i.e., in FIG. 1, perpendicularly to the plane of the drawing) in the usual manner to form a packaging material tube around the successively fed pieces of material to be packaged, e.g., chocolate bars 4, is then folded back in the direction of arrows 5, whereupon the edge regions 6, 6' (FIG. 2) of the packaging material 1 are joined together to form a longitudinal sealing seam.

Figure 2:
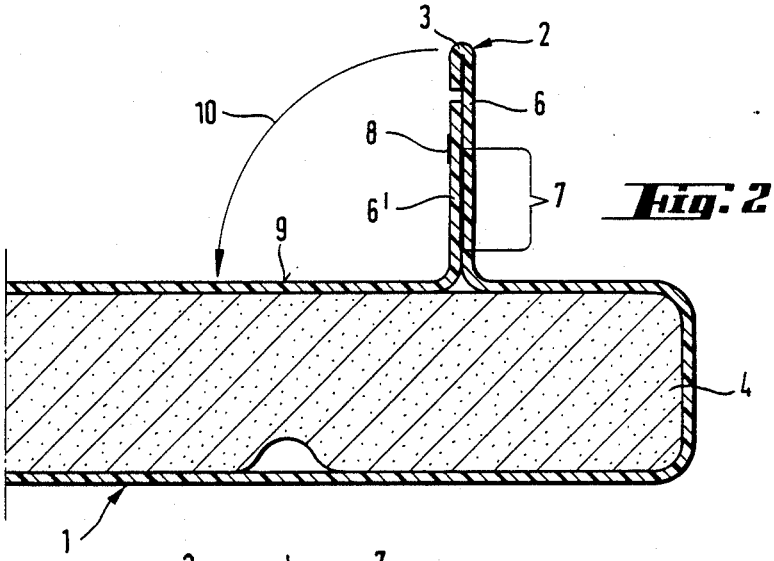
FIG. 2 is a partial cross-sectional view of a chocolate bar in the package before sealing and FIG. 3 is a partial cross-sectional view of the same chocolate bar in the package after sealing

FIG. 2 shows a chocolate bar 4 enclosed by the packaging material tube in a partial sectional view. The cold sealing joint of the two edge regions 6, 6' along the longitudinal sealing seam is effected over a strip-shaped sealing region 7 extending in the longitudinal direction of the packaging material (e.g., in FIG. 2, in a direction perpendicular to the plane of the drawing).

Figure 3:
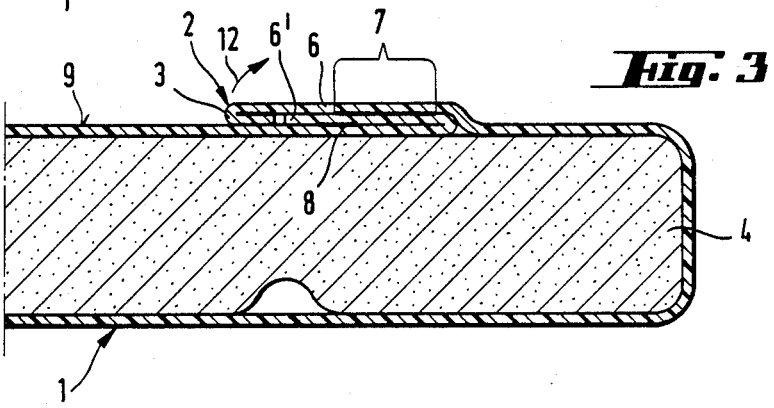

Following the creation of the packaging material tube, a hotmelt adhesive 8 is applied preferably to the outside of edge region 6' and immediately thereafter, the two edge regions 6, 6' joined together into a longitudinal sealing seam are folded back in the direction of arrow 10 onto the outside surface of the envelope 9 and thereby the outside of edge region 6' provided with the hotmelt adhesive is glued to the outside surface of the packaging envelope 9 before the melt adhesive soldifies (see FIG. 3).

The packaging material tube enclosing the chocolate bars 4 is now provided with two cross sealing seams 21 running parallel to each other, namely between two successive bars of chocolate, and is subdivided into single tubular packs by severance cuts between these two cross sealing seams.

Figure 4:
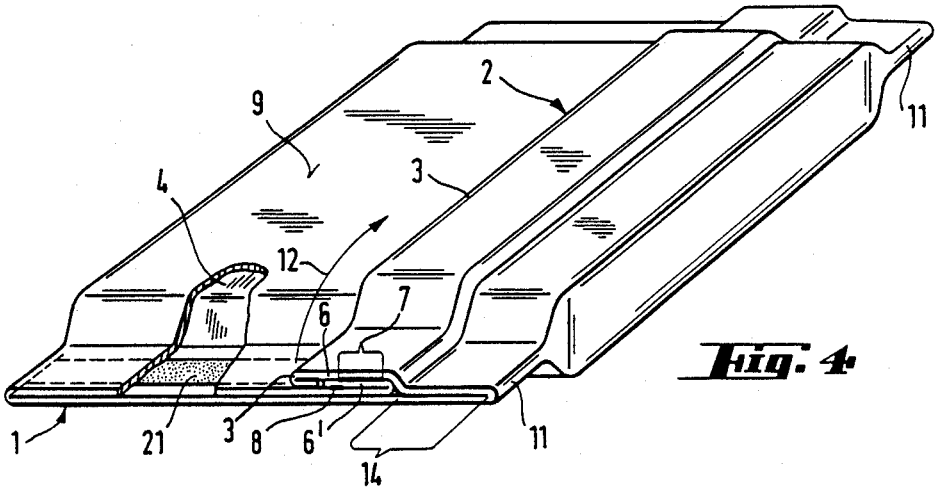
FIG. 4 is a perspective view of the final tubular bag pack of FIG. 3.

The thusly produced tubular bag pack is shown in FIG. 3 in a partial section and in FIG. 4 in perspective view. One can see the longitudinal sealing seam with fold 3 of edge region 6 folded back onto the envelope surface 9 a fixed by adhesion, as well as one of cross sealing seams 21 which now form the fins 11 of the tubular bag pack.

Figure 5:
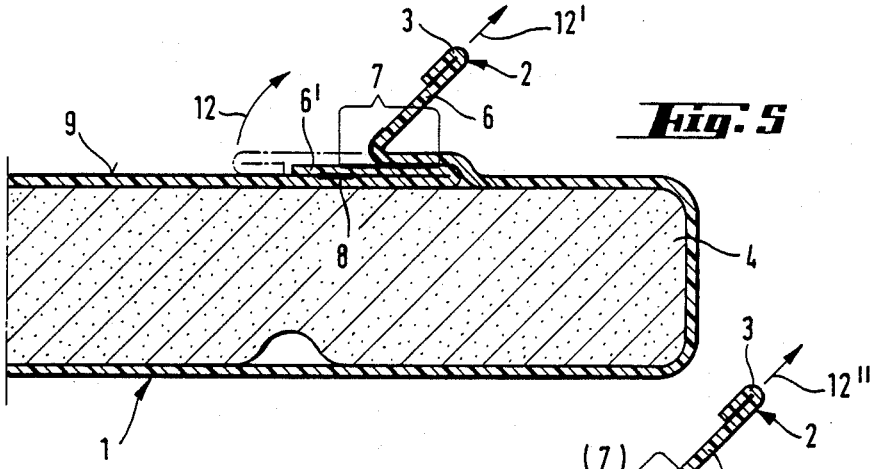
FIGS. 5 and 6 are partial views of the pack of FIG. 4 during opening.
Figure 6:
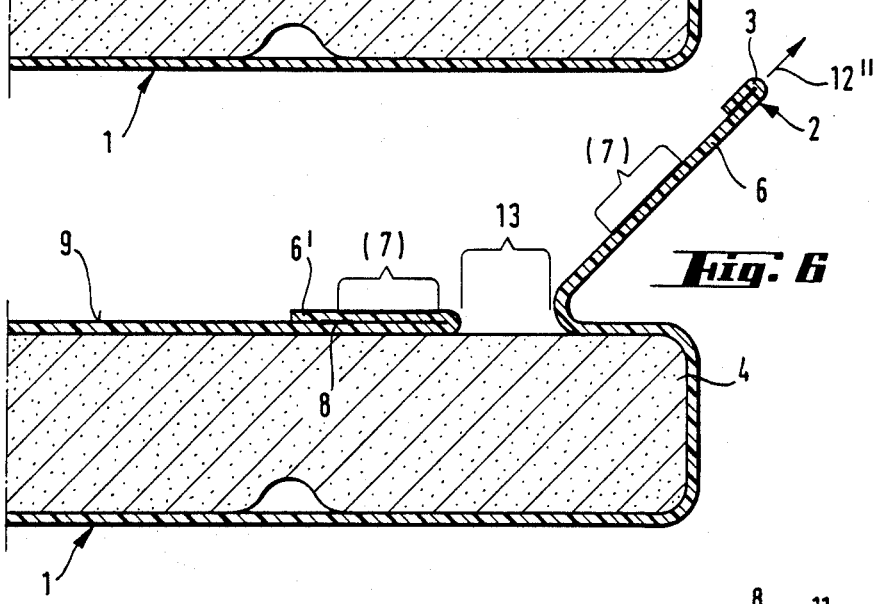

The opening of the pack is described in more detail with the aid of FIGS. 5 and 6 which—in a partial view similar to FIG. 3—show two different phases of the opening process. To open the pack, the edge region 6 is held at fold 3, raised in the direction of arrow 12 (FIG. 3) and then pulled in the direction of arrow 12' resp. 12'' (FIG. 5 and 6). As can be seen from FIG. 5, the edge region 6 is peeled off from edge region 6' severing the sealing joint 7 of the longitudinal sealing seam, until finally (FIG. 6) the two edge regions 6 and 6' are completely separated from each other. With the increasing peeling off of edge region 6 in the direction of arrow 12'', an increasingly widening opening 13 is thereby formed in the envelope. During the opening process, after the severance of sealing joint 7 in the longitudinal sealing seam—depending on the design of the packaging material or the level of the sealing seam strength—the cross sealing seams 21 of fins 11 are peeled off in region 14 (FIG. 4) or the packaging material tears in this region 14 into these fins 11.

In the pack described above, for example, a three-layered packaging material is used, as illustrated in FIG. 1 in enlarged detail section. Starting from the outside of the pack, this packaging material consists of a film 17 of biaxially stretched polypropylene 0.012 to 0.015 mm thick, an enameled paper 18 with a weight of 40 to 60 g/m$^2$, an aluminum foil 19 0.007 to 0.009 mm thick, and a cold sealing coating 20 on a latex base (2 to 7 g/m$^2$ solid material), preferably applied in profile.

Another advantageous packaging material structure consists of a polypropylene film, 0.01 to 0.015 mm thick, to which, on the inside of the pack, there is joined a metallized polypropylene film, 0.020 to 0.025 mm thick, or a metallized film of polyethylene terephthalate (PETP), 0.012 to 0.020 mm thick, and thereto the cold sealing coating.

For the production of a relatively inexpensive pack, it is advantageous to select as packaging material a composite consisting—starting from the outside of the pack—of an aluminum foil 0.007 to 0.009 mm thick, a paper with a weight of 35 to 60 g/m$^2$, and the cold sealing coating.

Figure 7:
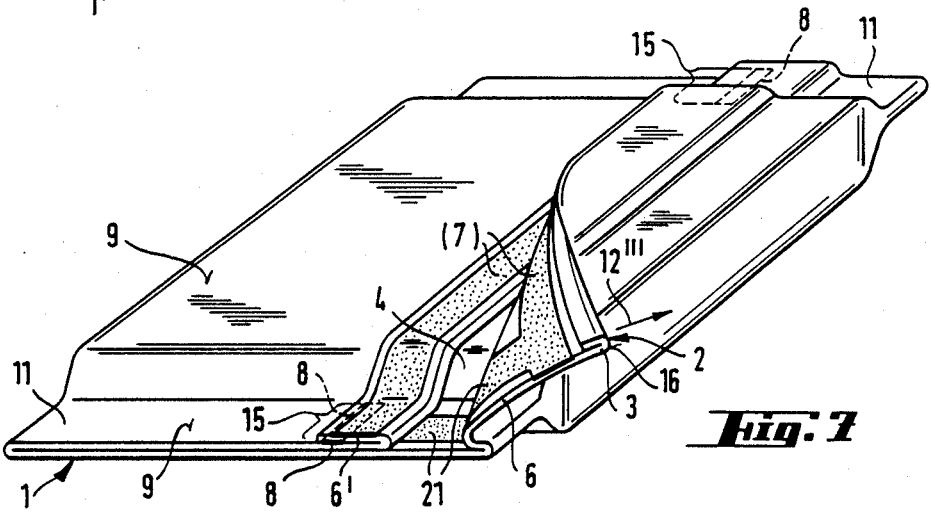
FIG. 7 is a perspective view of a tubular bag pack in a semi-opened state.

FIG. 7 shows, in perspective view, a tubular bag pack in semi-opened state. This pack differs from the pack according to FIG. 4 in that in it, the edge range 6' is joined to envelope surface 9 only within the regions 15 at the cross sealing seams 21 of fins 11, for example, by sealing by means of a punctiformly applied hotmelt adhesive 8. By producing the cross sealing seams 21, the longitudinal sealing seam existing between the two edge regions 6, 6' is pulled tight, kept in this state by sealing in the regions 15 and thereby fixed in its folded position along its entire length.

Opening of the pack is done by holding the end 16 of the edge region fold 3 and peeling in the direction of arrow 12''', whereby for complete opening, the holding action along fold 3 is advantageously repeated once or twice. In FIG. 7, the peeled off areas of the longitudinal sealing seam 7 resp. the cross sealing seam 21 of a fin 11 are indicated by dotted lines.

COMMERCIAL UTILIZATION

The pack according to the invention, essentially impermeable to air and easy to open, can be used, preferably in the form of a tubular bag pack, to advantage for packaging of chocolate, wafers and other products, which are made in the form of bars.

I claim:

1. Pack for packaging goods in the form of pieces with an envelope covering the goods and being formed of a flat, foldable packaging material, having an inside surface, which, over the largest part of its area, is facing the goods and having two edge regions of the packaging material extending parallel to each other and being joined together by means of a detachable seal at the inside surface of the packaging material within a sealing region, particularly one in the form of a strip, characterized by that the two edge regions (6,6') are folded back onto an outer surface of the envelopes (9), whereby the one edge region (6') which adjoins the outer surface of the envelope (9) is joined by bonding to the outer surface of the envelope (9) over at least a part of the area of said one edge region (6'), and that the strip-shaped sealing region (7) does not extend to the edge of the packaging material at the other edge region (6) which is not bonded to the outer surface of the envelope (9).

2. Pack according to claim 1, characterized by that this bonding to the outside surface of the envelope (9) is carried through by a hotmelt adhesive.

3. Pack according to claim 1, characterized by that it is a tubular bag pack having a longitudinal sealing seam and two cross sealing seams, in which the edge regions (6,6') of the packaging material joined together by a seal and folded back onto the outer surface of the envelope (9) form the longitudinal sealing seam of the tubular bag, and that the one edge region (6') folded back onto and adjoining the outer surface of the envelope (9) is joined by bonding to the outer surface of the envelope (9) only at or in the region (15) of the cross sealing seam(s) of the tubular bag pack.

4. Pack according to claim 1, characterized by that it is a tubular bag pack with longitudinal and cross sealing seams produced by cold sealing.

5. Pack according to claim 1, characterized by that in the one edge region (6) of the two parallel edge regions (6,6') which is not bonded with the envelope surface (9), the packaging material forms a fold (3) between the strip-shaped bonding region (7) and the edge of the packaging material, in which fold the inside surfaces of the packaging material adjoin each other.

6. Pack according to claim 5, characterized by that the adjoining inside surfaces of the packaging material of the fold (3) are bonded together by cold sealing.

* * * * *